US005165604A

United States Patent [19]

Copp, Jr.

[11] Patent Number: 5,165,604

[45] Date of Patent: Nov. 24, 1992

[54] AIR SUPPLY AND CONTROL ASSEMBLY FOR AN AUTOMATIC SPRAY GUN

[76] Inventor: William H. Copp, Jr., 5 Solomon Pierce Rd., Lexington, Mass. 02173

[21] Appl. No.: 770,431

[22] Filed: Oct. 3, 1991

[51] Int. Cl.[5] ..... B05B 7/08; B05B 15/02

[52] U.S. Cl. ..... 239/106; 239/290; 239/412; 239/413

[58] Field of Search ..... 239/290, 296, 300, 301, 239/412–415, 112, 113, 106

[56] References Cited

U.S. PATENT DOCUMENTS

| | | | |
|---|---|---|---|
| 3,322,351 | 5/1967 | Hackel | 239/412 |
| 3,622,078 | 11/1971 | Gronert | 239/412 |
| 3,667,682 | 6/1972 | Purnell | 239/412 |
| 4,759,502 | 7/1988 | Pomponi, Jr. et al. | 239/300 |
| 4,844,342 | 7/1989 | Foley | 239/415 |
| 5,058,807 | 10/1991 | Smith | 239/290 |
| 5,067,656 | 11/1991 | Copp, Jr. | 239/290 |
| 5,080,285 | 1/1992 | Toth | 239/300 |

*Primary Examiner*—Andres Kashnikow
*Assistant Examiner*—Karen B. Merritt
*Attorney, Agent, or Firm*—Ernest Kettelson

[57] ABSTRACT

An air supply and control assembly for use with a spray gun comprises an assembly to couple a first source of pressurized air which controls the needle valve of a spray gun to a pilot valve connected to a second source of pressurized air to control delivery thereof to the spray gun atomizing component. The assembly includes a manifold connected by one port to the first source of air, by a second port to components operating the needle valve, and by a third port to a coupling passageway connected to the pilot valve. A check valve in the coupling passageway allows air from the first source to flow freely to a chamber in the pilot valve which, on receipt of air from the first source, opens to flow air from the second source to the atomizing component, and impedes return flow of air from the chamber back to the manifold after the first source of air has been discontinued which thereby keeps the pilot valve open to continue flow of air from the second source to the atomizing component for a selected time period until all of the air from the first source in the pilot valve chamber has escaped. The check valve is adjustable to alter the time delay of the pilot valve in closing. To provide a high volume low pressure (HVLP) supply of atomizing air to the atomizing component a venturi member draws ambient air in to combine with pressurized air from the second source.

16 Claims, 9 Drawing Sheets

AIR SUPPLY AND CONTROL ASSEMBLY FOR AN AUTOMATIC SPRAY GUN

BACKGROUND OF THE INVENTION

This invention relates to the combined fields of air supply systems which supply pressurized air to spray gun equipment and control devices to control the flow of such pressurized air. It relates in particular to an air supply and control assembly which provides a high volume low pressure (HVLP) supply of pressurized air and control means coupled therewith.

Prior art spray equipment has utilized pressurized air at relatively high air pressure with little thought that for a number of applications a lower pressure of air and a relatively higher volume of air would do a superior job. In recent years, it has been recognized that it is not enough to merely connect spray equipment to an air compressor or other pressurized air source, but that some method of increasing the volume of air flow per time unit and lowering the air pressure per square inch or other dimensional measurement is desirable. A number of high volume, low pressure (HVLP) air supply devices and air spray devices have been proposed and offered in recent years, often with less than satisfactory results.

The air supply and control assembly in accordance with the present invention is an improvement over the prior art and includes (A) an improved high volume, low pressure (HVLP) air supply component in combination with (B) a control component which couples a first source of pressurized air (for controlling operation of the needle valve and liquid output from the orifice of a spray gun) to a second source of pressurized air (for atomizing the output from the spray gun) to, by such coupling, control the flow of the second source of pressurized air to the atomizing component of the spray gun.

Such control of the flow of atomizing air to the spray gun includes (1) simultaneous flow thereof as soon as the first source of pressurized air is flowed to the spray gun to open its needle valve for flow of liquid to be atomized and sprayed so that atomizing air from the spray gun is available to atomize and spray the liquid as soon as it begins to flow from the nozzle orifice of the spray gun, (2) shutting off the flow of pressurized air from the second source after pressurized air from the first source has been shut off, and (3) delaying shut off of the flow of pressurized air from the second source for a predetermined time after pressurized air from the first source has been shut off to be sure that atomizing air is still being emitted from the spray gun to atomize and spray any liquid that may continue to flow from the spray gun orifice after the first source of pressurized air is shut off (signalling the needle valve to close the nozzle orifice) and the time it takes thereafter for the needle valve to fully seat in and fully close the nozzle orifice.

The present invention thus solves a problem of prior art devices and prevents an unintended stream of non-atomized liquid from flowing out of the spray gun when it has been signaled to discontinue its operation. Any such stream of non-atomized liquid on to the work pieces ruin such work and require rejection of those work pieces.

The HVLP air supply component of the present invention includes a venturi member which receives pressurized air from the second source into and through a venturi nozzle whose outlet is centered in the outwardly flared throat portion of an elongated cylindrical venturi member. A rearward portion of the elongated venturi member adjacent to the throat section on its upstream side includes a plurality of radially spaced apart apertures extending through its cylindrical wall and opening to its central passageway at a point adjacent to and slightly upstream from the narrowed neck portion and downstream outlet of the venturi nozzle, to draw ambient air therein through an air filter mounted in and through the wall of a sleeve member surrounding the rearward portion of the elongated venturi member. The ambient air drawn into the venturi member and pressurized air from the second source provides a supply of high volume low pressure (HVLP) atomizing air to the atomizing component of the spray gun.

The control component of the present invention comprises a coupling assembly to couple the first source of pressurized air (which controls operation of the needle valve of a spray gun) to a pilot valve which is connected to the second source of pressurized air (which controls supply thereof to the atomizing component of the spray gun). The coupling assembly includes a manifold which has one port connected to the first source of pressurized air, a second port connected to the piston and cylinder component of the spray gun which operates the needle valve, and a third port connected to a coupling passageway which is connected to a pilot valve.

The pilot valve includes an air chamber to receive pressurized air from the first source therein from the manifold and through the coupling passageway. The pilot valve includes a valve operator to move its valve closure member from an air flow closed position to which it is normally biased to its air flow open position when air pressure from the first source enters the air chamber of the pilot valve. Pressurized air from the second source can then flow through the pilot valve and through the venturi member connected to the pilot valve to supply high volume low pressure (HVLP) atomizing air to the atomizing component of the spray gun.

A control center, such as a computerized control assembly, controls the operation of the first source of pressurized air. When the control center wants to start a spraying operation it opens the flow of pressurized air from the first source which flows through the ports of the manifold to initiate both the flow of liquid from the spray gun nozzle orifice and atomizing air from the atomizing component of the spray gun. When the control center decides to stop a spraying operation, it closes the flow of pressurized air from the first source. The needle valve of the spray gun is then no longer pressurized to its valve open position whereupon biasing means biases it back toward its valve closed position. At the same time, pressurized air from the first source in the air chamber of the pilot valve begins to escape therefrom, after which the closure member of the pilot valve is biased to its closed position to cut off further flow of pressurized air from the second source to the atomizing component of the spray gun.

To provide the desired time delay in shutting off atomizing air to the spray gun until a certain amount of time has elapsed after shutting off the flow of pressurized air from the first source to the needle valve operating component of the spray gun, a check valve is provided in the coupling passageway. When a spraying operation is to start, the check valve allows first source pressurized air to flow freely to the chamber of the pilot valve enabling it to open immediately to begin flow of atomizing air to the spray gun. However, the check valve impedes return flow of the first source pressurized air out from the pilot valve chamber back to the manifold after that first source of pressurized air to the manifold has been shut off by the control center to discontinue the spraying operation. The longer such return flow of first source pressurized air from the pilot valve chamber is impeded, the longer it will stay open to continue supply of atomizing air to the spray gun.

The check valve is adjustable so as to vary the return flow of first source pressurized air from the air chamber of the pilot valve and thus the length of time the pilot valve remains open and the length of time atomizing air will continue to flow out from the spray gun after the first source of pressurized air has been shut off signalling the needle valve of the spray gun to close.

In order to make the rate of air flow in the coupling passageway more uniform and predictable, an enlarged capacity accumulator chamber is connected in the coupling passageway between the check valve and the pilot valve. As pressurized air from the first source flows into and through the coupling passageway to the pilot valve, the accumulator chamber fills with pressurized air. When pressurized air from the first source is shut off and return flow from the air chamber of the pilot valve begins, pressurized air from the accumulator chamber also flows into the coupling passageway and toward the manifold thus joining air from the air chamber of the pilot valve in its return flow back toward the manifold thus insuring a more uniform rate of flow. The time delay for any particular setting of the check valve can thus be predicted and determined more accurately, and more uniformly for each repeated operation.

A more complete description of the manifold, check valve, pilot valve, accumulator chamber and venturi is set forth hereinbelow and as illustrated in the accompanying drawings.

SUMMARY OF THE INVENTION

It is an object of the invention to provide a pressurized air supply and control assembly for an automatic spray gun in which the air supply component includes a venturi member connected therein to draw ambient air into the supply line for combining with pressurized air from a pressurized air supply source and thereby supply high volume low pressure (HVLP) atomizing air to a spray gun.

It is an object of the invention to provide a pressurized air supply and control assembly for an automatic spray gun in which the control component includes a coupling assembly to couple a first source of pressurized air (for control and operation of the needle valve of a spray gun) to a pilot valve connected to a second source of pressurized air (for the atomizing component of a spray gun to atomize liquid flowing from its nozzle when the needle valve is opened), whereby atomizing air can be continued to the spray gun for a preselected time after the needle valve has been signalled to close by discontinuing flow of said pressurized air from said first source.

It is an object of the invention to provide a pressurized air supply and control assembly for an automatic spray gun which includes in its control component a pilot valve member having an operating mechanism able to utilize the existing control means for controlling operation of the needle valve of a spray gun to also control the supply of pressurized atomizing air to the atomizing component of the spray gun.

It is an object of the invention to provide a pressurized air supply and control assembly for an automatic spray gun which includes in its control component a check valve having an adjusting mechanism whereby pressurized air can flow freely in one direction but in which return air flow in the opposite direction can be impeded to varying degrees.

It is an object of the invention to provide a pressurized air supply and control assembly for an automatic spray gun which includes in its control component a check valve, a pilot valve, a coupling air passageway connecting the two, and an accumulating air chamber connected in said coupling air passageway between said check valve and said pilot valve.

DESCRIPTION OF PREFERRED EMBODIMENT

Figure 1:
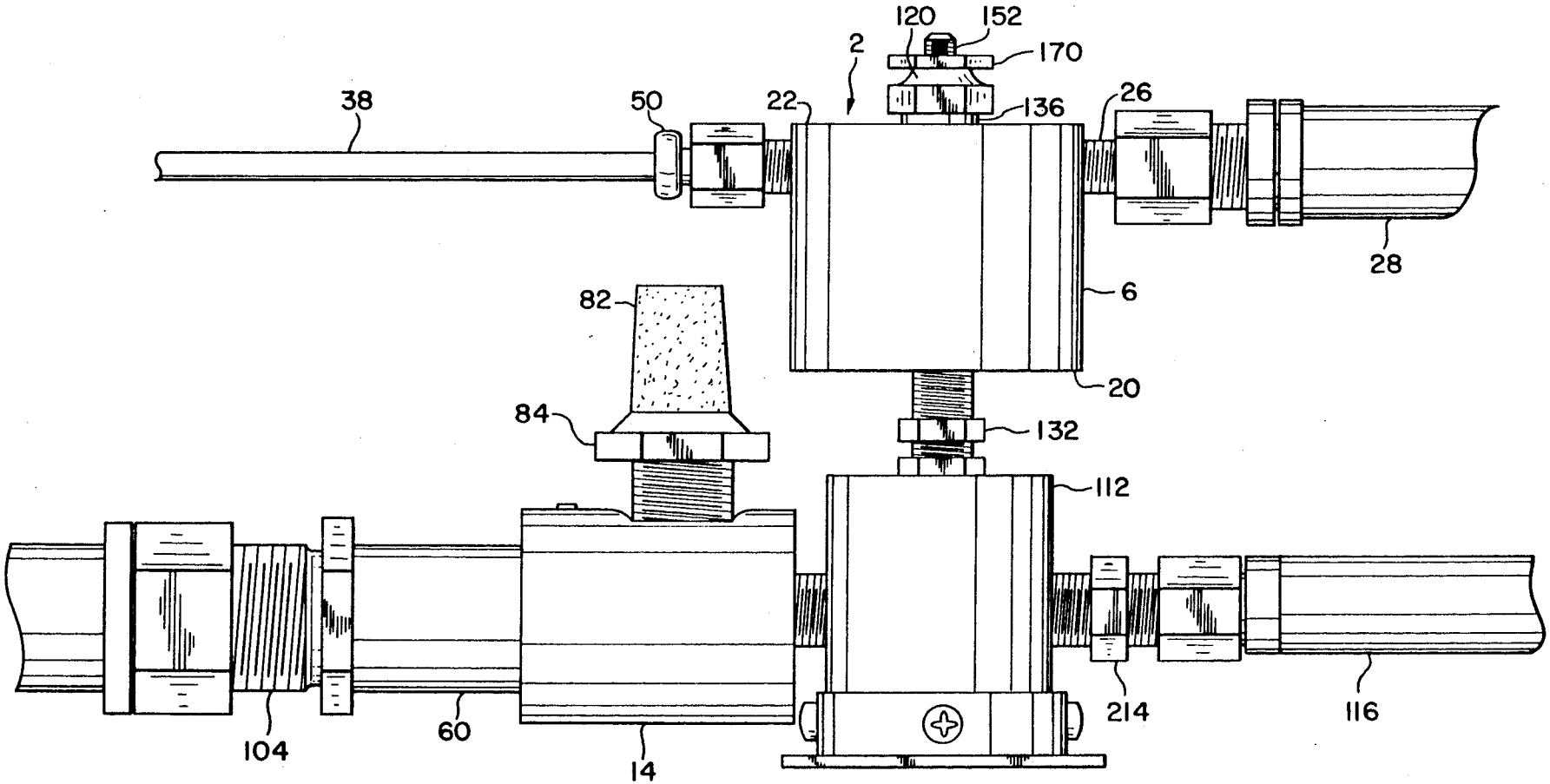
FIG. 1 is an elevation view of a pressurized air supply and control assembly for a high volume, low pressure (HVLP) spray gun in accordance with this invention.
Figure 2:
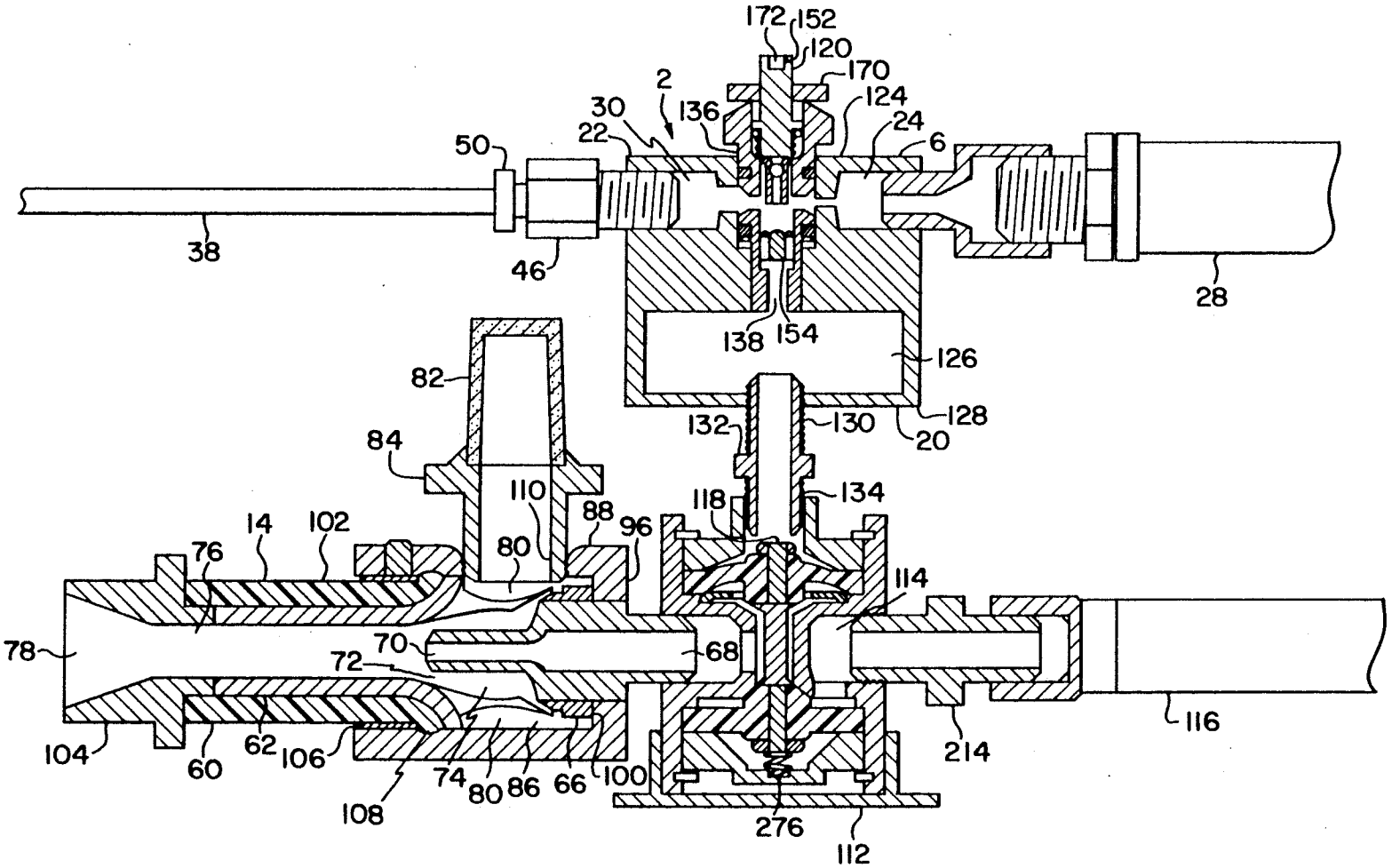
FIG. 2 is a section view of the pressurized air supply and control assembly shown in FIG. 1 wherein the pivot valve component of the control assembly is shown in its position which closes flow of atomizing air to the spray gun.
Figure 3:
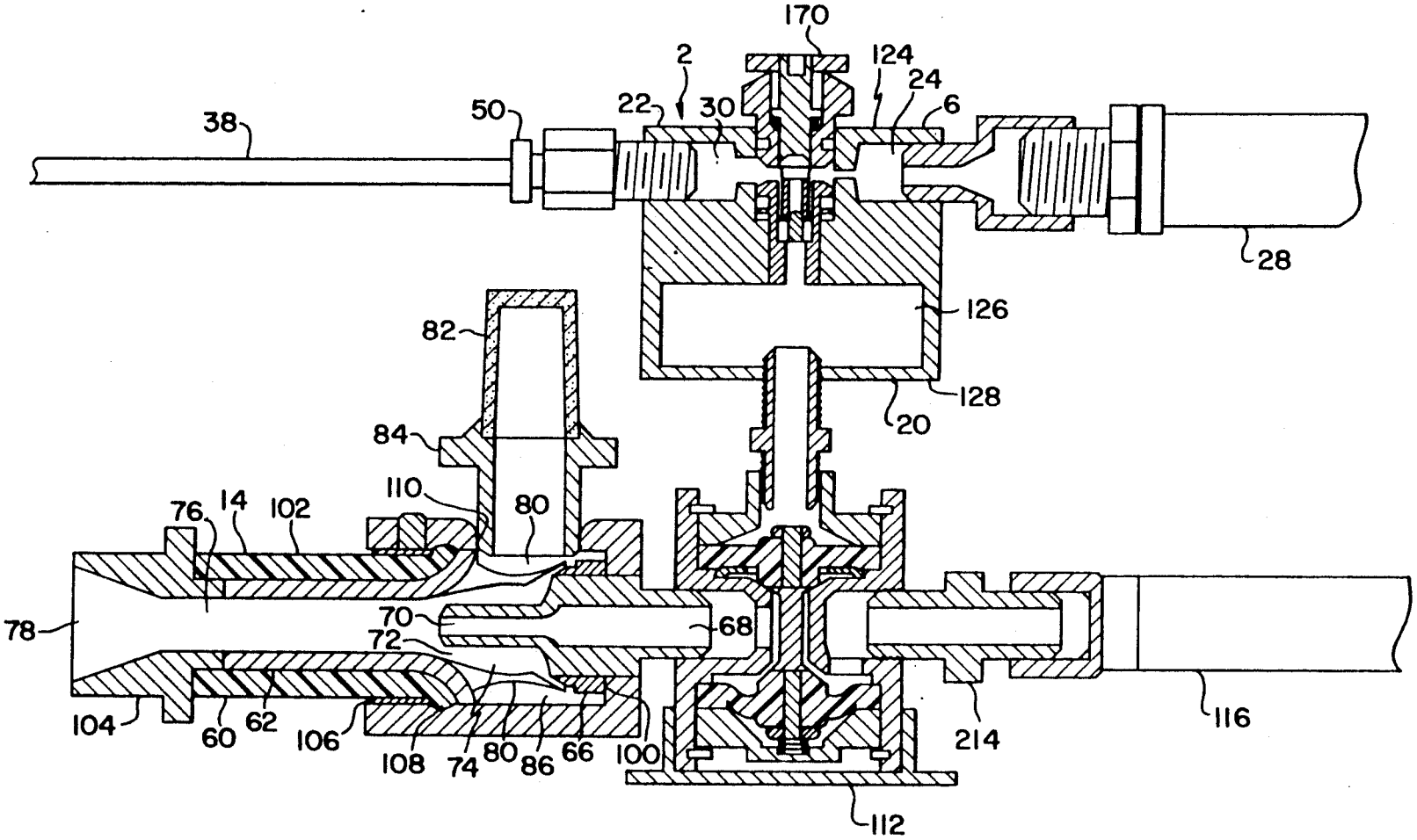
FIG. 3 is a section view similar to that of FIG. 2 but with the pilot valve shown in its position which opens flow of atomizing air to the spray gun.
Figure 4:
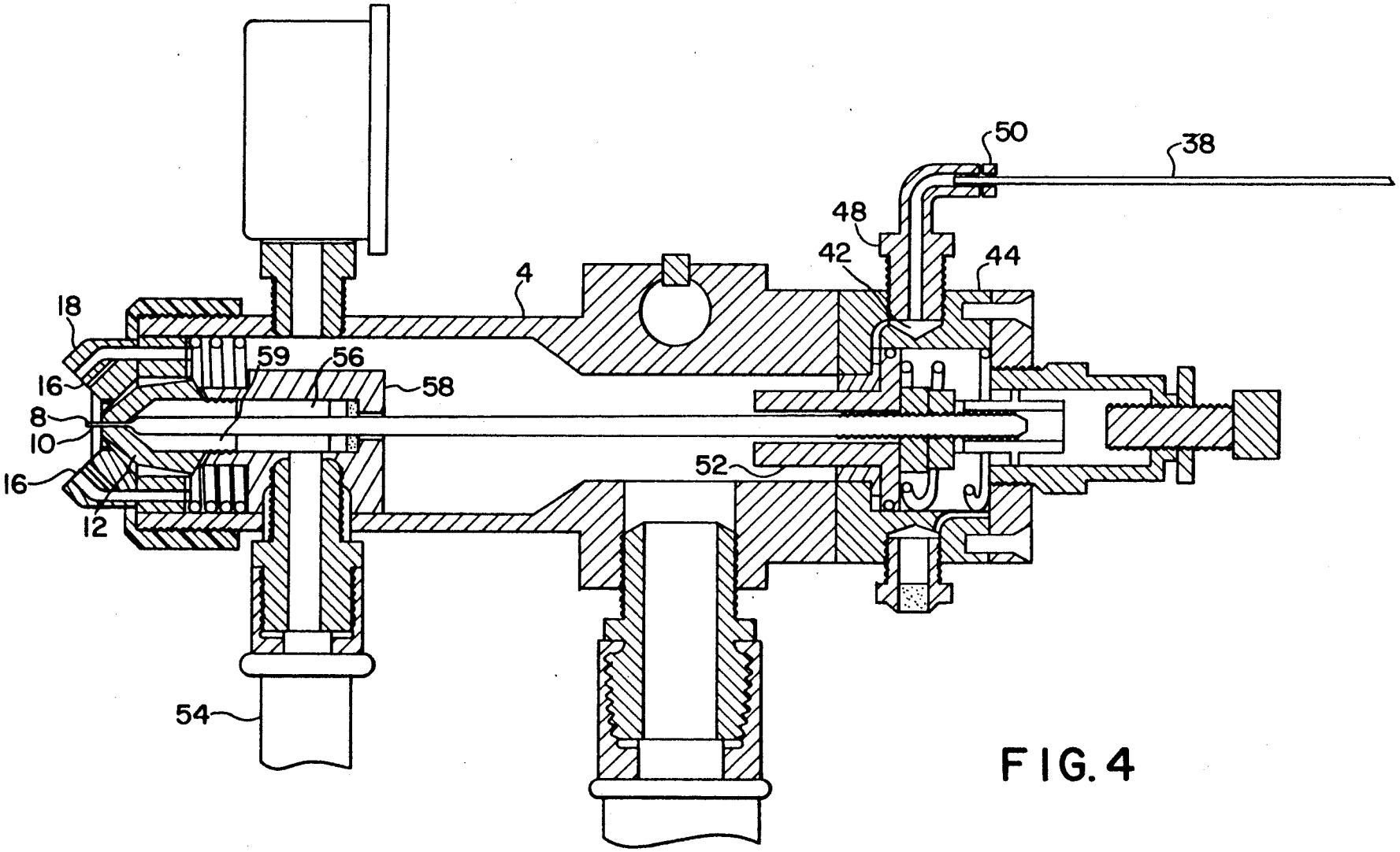
FIG. 4 is a section view of a high volume, low pressure (HVLP) spray gun for use with the pressurized air supply and control assembly in accordance with this invention.
Figure 5:
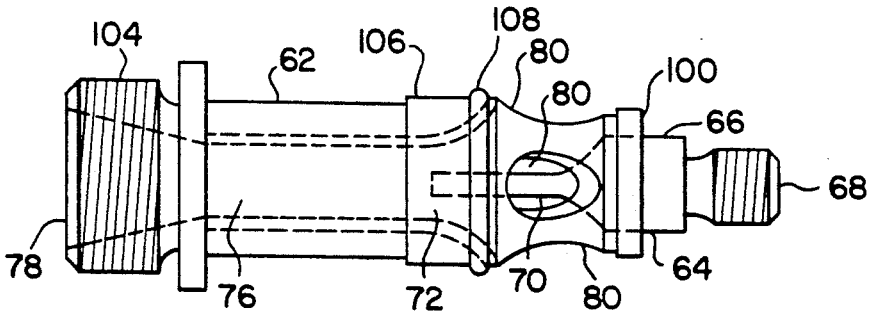
FIG. 5 is a side elevation view of the venturi member component of the air supply assembly in accordance with this invention.
Figure 6:
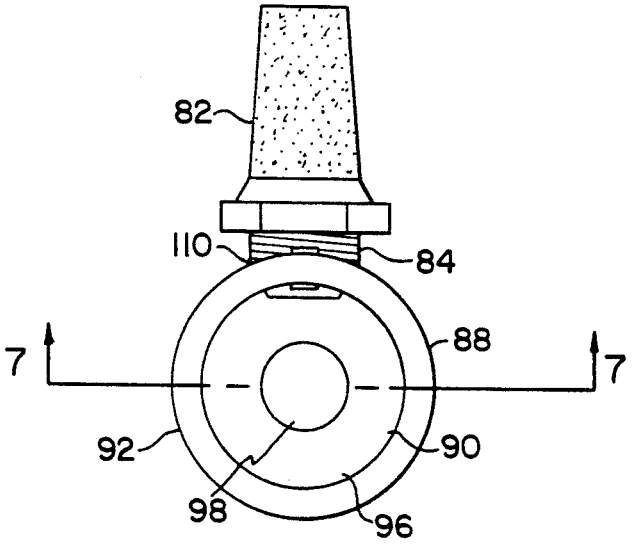
FIG. 6 is an end elevation view of a cylindrical sleeve member into which the rearward end portion of the venturi member shown in FIG. 5 is received.
Figure 7:
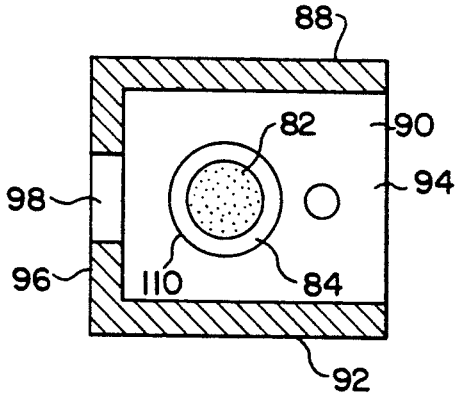
FIG. 7 is a section view taken on line 7—7 of FIG. 6.
Figure 8:
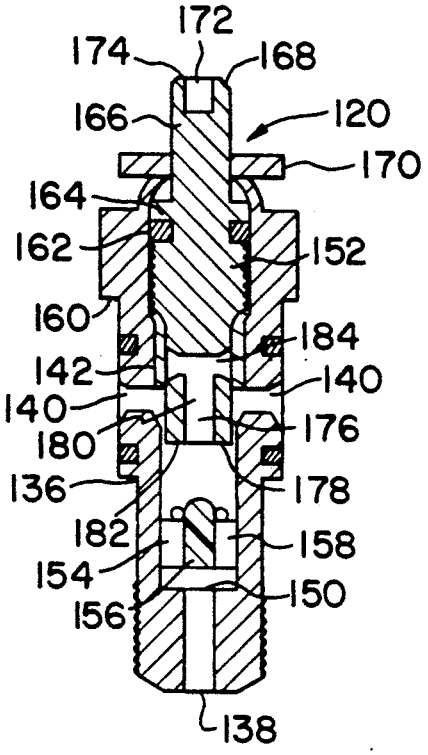
FIG. 8 is a section view of the check valve component of the control assembly in accordance with this invention.
Figure 9:
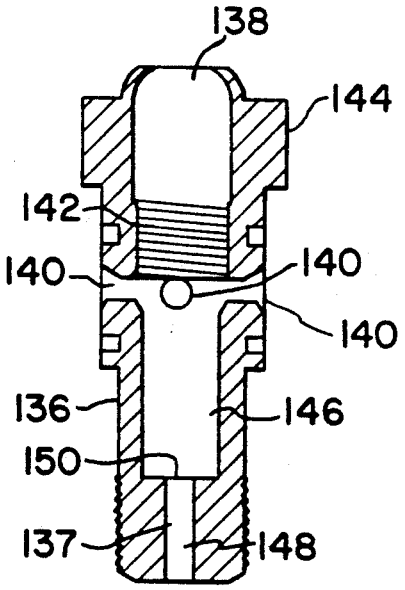
FIG. 9 is a section view of the valve body of the check valve shown in FIG. 8.
Figure 10:
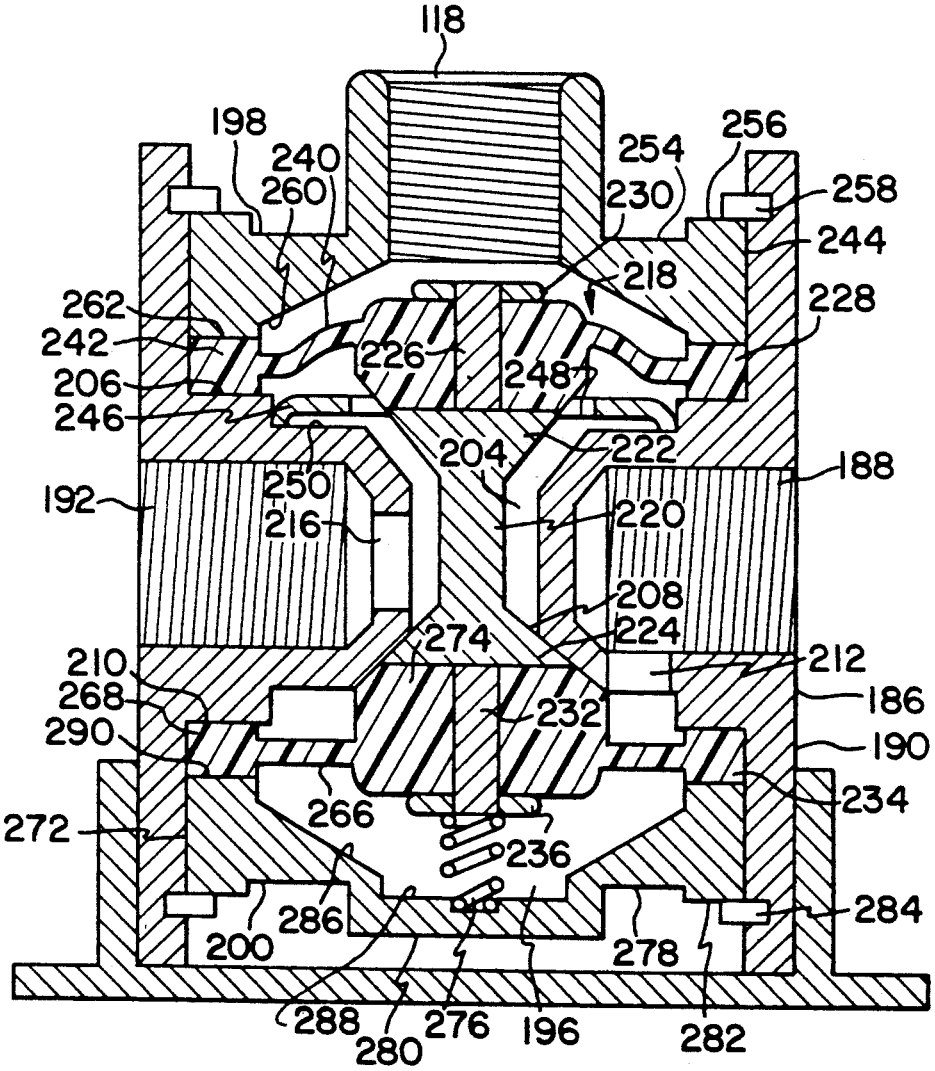
FIG. 10 is an enlarged section view of the pilot valve component of the control assembly in accordance with this invention.
Figure 11:
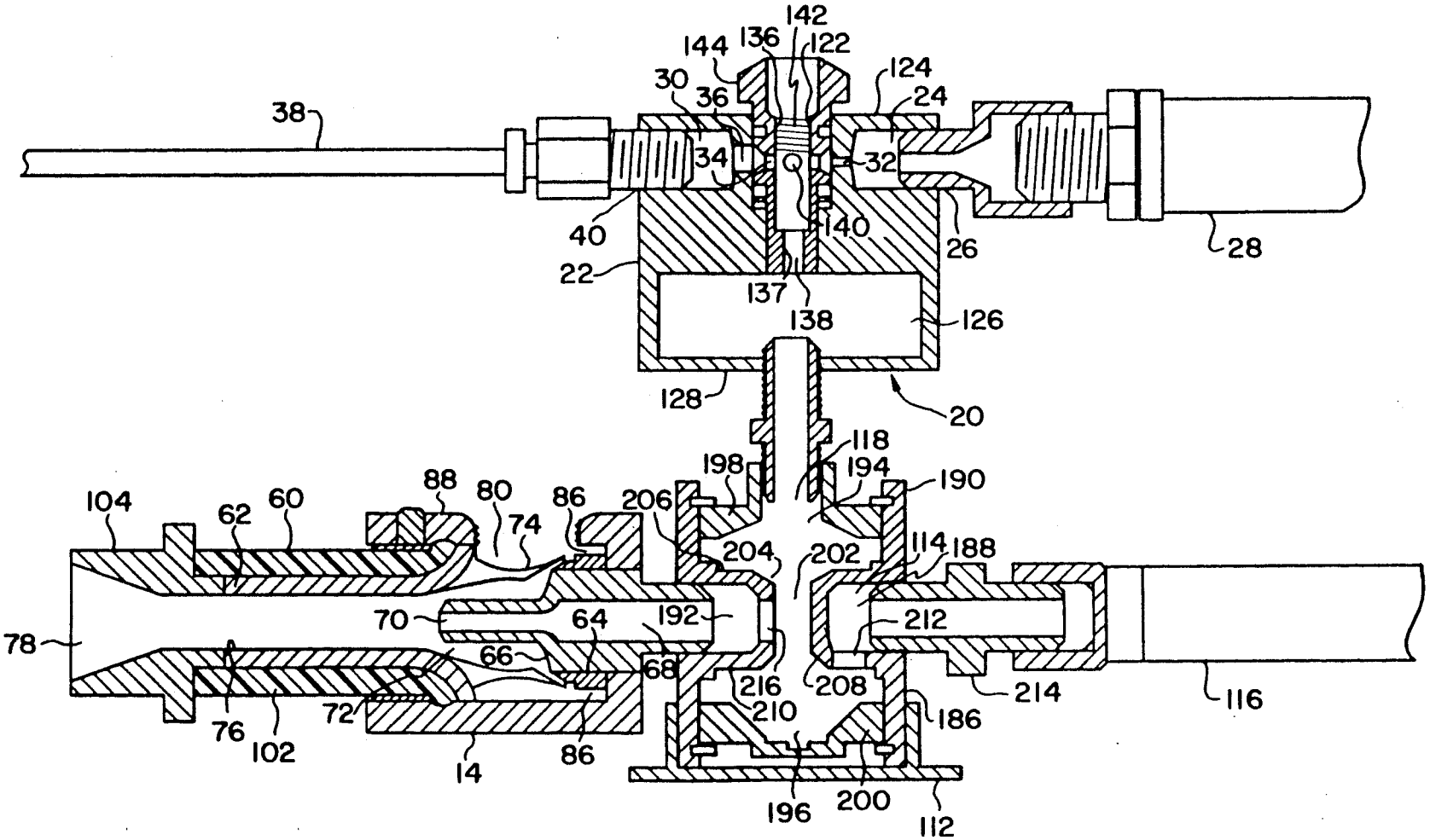
FIG. 11 is a section view of the pressurized air supply and control assembly shown in FIG. 1 wherein the valve operating parts have been removed from the pilot valve component to more clearly illustrate the interior portions of the valve housing and air passageways through the valve.
Figure 12:
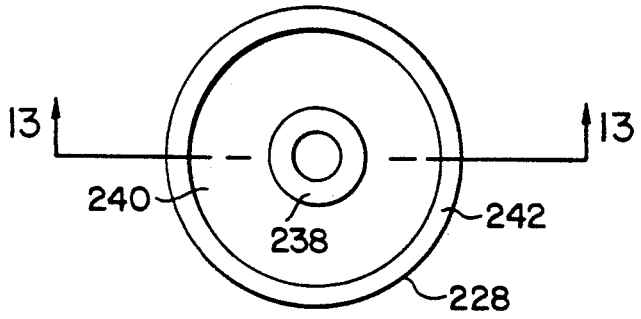
FIG. 12 is a top plan view of the upper chamber membrane of the two chamber, two-way pilot valve as shown in the section view of FIG. 10.
Figure 13:
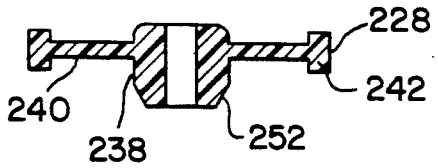
FIG. 13 is a section view taken on line 13—13 of FIG. 12.
Figure 14:
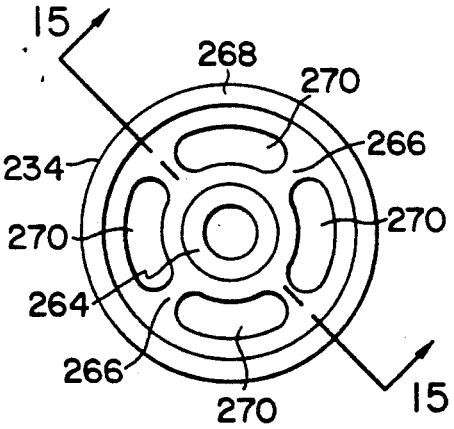
FIG. 14 is a bottom plan view of the lower chamber membrane of the pilot valve.
Figure 15:
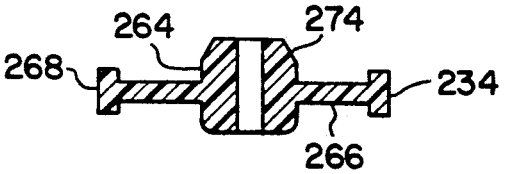
FIG. 15 is a section view taken on line 15—15 of FIG. 14.

A pressurized air supply and control assembly 2 to supply pressurized air to a robotic paint spray gun 4 and control operation thereof in accordance with this invention comprises (A) a control air supply system 6 to retract the spray gun's oppositely biased needle 8 away from the orifice 10 of the spray gun's nozzle 12 for paint under pressure from a pressurized paint supply source to flow through nozzle orifice 10, (B) an atomizing air supply system 14 to flow pressurized air through the apertures 16 of the air cap 18 directed to intercept and atomize the flow of paint as it is flowed outwardly from nozzle orifice 10, and (C) a time delay system 20 to continue operation of said atomizing air supply system 14 for a preselected time after the control air supply system 6 has been interrupted and until the needle 8 has been biased fully to its seated position in nozzle orifice 10 for closure thereof and discontinuance of further flow of paint therethrough. Thus, as long as nozzle orifice 10 is open even slightly to permit any paint at all from its pressurized supply source to flow through the orifice 10, whatever paint does flow through will be atomized. An undesirable stream of non-atomized paint will not occur as a result of the time delay system 20 in accordance with this invention.

The control air supply system 6 comprises a manifold 22 having a receiving chamber 24 to receive pressurized air through its inlet port 26 and supply line 28 from a computer controlled source of pressurized air to which supply line 28 is connected. The manifold 22 includes a discharge chamber 30 to receive pressurized air from the receiving chamber 24 through the small diameter outlet port 32 of the receiving chamber 24, through a connecting conduit 34, and through the enlarged diameter inlet port 36 of the discharge chamber 30.

Pressurized air from the computer controlled supply is provided to the spray gun 4 to retract its needle 8 from nozzle orifice 10 when painting is to begin through a needle control supply line 38 connected at one end to the discharge port 40 of the manifold discharge chamber 30 and at its opposite end to the inlet port 42 of the spray gun operating cylinder 44.

Quick connect fittings are provided for easy and quick connection of the needle control supply line 38, including quick connect manifold fitting 46 secured to the discharge port 40 of the manifold 22 and quick connect cylinder fitting 48 secured to the inlet port 42 of the spray gun operating cylinder 44. Each quick connect fitting 46 and 48 includes a compression collar 50 biased inwardly to grip and hold the end portion of supply line 38 received in the respective fitting. To release the supply line from these quick connect fittings, the compression collars may be pulled outwardly which expands the compressive grip mechanism enough to release its grip and enable withdrawal of the supply line from the fittings.

Pressurized air from the computer controlled supply thus flows to the operating cylinder 44 of the spray gun 4 when a painting operation is to begin, thereby forcing the forwardly biased operating piston 52 rearwardly which draws the elongated needle 8, which has a bearing threaded on its rearward end for contact with the rearward facing surface of the piston 52, away from the nozzle orifice 10. Paint from a pressurized paint supply source can then flow through the paint supply conduit 54 into the paint chamber 56 of the nozzle block 58 and out through the now open orifice 10 of the nozzle 12 threadedly secured to the discharge port 59 of the nozzle block 58.

The atomizing air supply system 14 of the pressurized air supply and control assembly in accordance with this invention comprises a venturi assembly 60 which includes an elongated tubular member 62 having a rear wall aperture 64 to receive the cylindrical body portion of a venturi nozzle 66 therein. The venturi nozzle 66 includes an inlet port 68 having an enlarged inner diameter portion and a reduced diameter outlet port portion 70 which opens into the outwardly flared throat 72 of the elongated tubular venturi member 62.

The elongated venturi member 62 includes an enlarged diameter ambient air intake section 74 on the upstream side of the venturi throat 72 and a reduced diameter discharge conduit 76 extending from the downstream side of venturi throat 72 to the outwardly flared discharge aperture 78.

The ambient air intake section 74 includes a plurality of intake apertures 80 extending through the tubular wall thereof, each aperture 80 spaced apart radially around the ambient air intake section 74 to receive ambient air into the chamber of this enlarged diameter section of the elongated venturi member 62 on the upstream side of the venturi throat 72.

Ambient air is directed to the apertures 80 of the ambient air intake section 74 through an air filter 82 secured to an externally threaded fitting 84 which opens to an annular chamber 86 surrounding the air intake section 74 of the elongated venturi member 62 in communication with the plurality of intake apertures 80.

The annular chamber 86 is formed by an enlarged diameter cylindrical sleeve member 88, having an enlarged diameter cavity 90 corresponding in dimension to the outer diameter of the venturi throat 72, bounded by a cylindrical side wall 92, having an open forwardly facing end wall 94 and a solid rearwardly facing end wall 96 with a cylindrical aperture 98 whose diameter corresponds in dimension to the outer diameter of the enlarged inlet end portion of the venturi nozzle 66 which is received in the cylindrical aperture 98.

The inlet end portion of the elongated venturi member 62 is received in the cavity 90 of sleeve member 88, with the enlarged inlet end portion of venturi nozzle 66 received in the cylindrical aperture 98. Such end portion of venturi nozzle 66 projects rearwardly and outwardly from the rearwardly facing end wall of the elongated venturi member 62 a distance equal to the thickness of the rearwardly facing wall 96 of the sleeve member 88. When the elongated venturi member 62 is received in the cavity 90 of the sleeve member 88, the rearwardly projecting end of the venturi nozzle 66 seats in the end wall aperture 98 flush with the outer surface of end wall 96 and the rearwardly facing annular end wall 100 of the elongated venturi member 62 abuts against the inner surface of the rearwardly facing end wall 96 of the sleeve member 88.

The cylindrical side wall 92 of the sleeve member 88 extends forwardly from the rearwardly facing end wall 96 and terminates at the forwardly facing open wall 94 at a location forward of and downstream from the throat 72 of the venturi member 62. An elongated sleeve 102 of firm but somewhat resilient material such as hard rubber is provided around the elongated reduced diameter neck or discharge conduit 76 of the venturi member 62, which extends from the throat 72 forwardly to the threaded fitting 104 which extends forwardly from the forward end of the elongated venturi member 62. An annular metal band 106 extends around the elongated sleeve 102 at its rearward end adjacent the throat 72 to secure the sleeve 102 in place on the neck 76 of the elongated venturi member 62. The dimension of the outer diameter of the sleeve 102 is slightly smaller than the inner diameter of the cylindrical cavity 90 of the cylindrical sleeve member 88. The outer diameter of the metal securing band 106 corresponds substantially to the inner diameter of the cylindrical cavity 90 for a snug fit when received therein. A short annular rearward end portion of the elongated sleeve 102 of hard rubber or other somewhat resilient material is sandwiched between the rear edge of the securing band 106 and the outer end of the flared throat 72 of the venturi member 62 forcing it to bulge outwardly and form an annular seal 108 between the inner cylindrical wall of the cylindrical sleeve member 88 and the flared entrance of the throat 72.

The outer annular dimension of the portions of the elongated venturi member 62 rearwardly from or upstream from the flared throat 72 is less than that of the inner annular wall of the cylindrical sleeve member 88 thereby forming the annular chamber 86 in the annular space therebetween.

The air filter 82 and its externally threaded fitting 84 are threadedly received in the internally threaded aperture 110 through the cylindrical side wall 92 of the cylindrical sleeve member 88. The aperture 110 is located forwardly of the rearward end wall 96 at a location which is substantially in registration with the annular space around the ambient air intake apertures 80 of the venturi member 62. Thus when pressurized air is flowed through the elongated venturi member 62 from its inlet port 68 to the discharge aperture 78, ambient air is drawn through the air filter 82, through aperture 110 of the cylindrical sleeve member 88 and into the annular chamber 86 from which the ambient air passes through the plurality of radially spaced apart apertures 80 of the venturi member 62, then drawn into and through the throat 72 where the ambient air merges with the pressurized air as it is flowed through the reduced diameter outlet port 70 of the venturi nozzle 66, to produce a relatively higher volume of air at relatively lower pressure at the discharge aperture 78. That is to say that volume of air at the discharge aperture 78 is relatively higher than the volume of pressurized air received at the inlet port 68 of the venturi nozzle 66, and the pressure at the discharge aperture 78 is relatively lower than the pressure of the pressurized air received at the inlet port 68 of the venturi nozzle 66.

The time delay system 20 of the pressurized air supply and control assembly in accordance with this invention comprises pilot valve assembly 112 having an operating pressurized air inlet port 114 connected by an operating pressurized air line 116 to a supply of operating or atomizing pressurized air for providing a supply of atomizing air to the spray gun 4, and an air inlet port 118 connected ultimately to the computer controlled source of pressurized air received through supply line 28.

A check valve 120 is seated in an elongated cylindrical receiving cavity 122 provided in the manifold 22. The longitudinal axis of the elongated receiving cavity 122 extends in a direction normal to that of the longitudinal axes of outlet port 32 of the manifold receiving chamber 24, and of the inlet port 36 of the manifold discharge chamber 30 which are axially aligned and which open to opposite sides of the cylindrical side wall of manifold 22. The elongated cylindrical receiving cavity 122 intersects the space between the inlet port 36 of manifold discharge chamber 30 and the outlet port 32 of the manifold receiving chamber 24.

The elongated receiving cavity 122 opens at its upper end to the upper end wall 124 of the manifold 22 and at its lower end to a cylindrical accumulator chamber 126 in the lower portion of the cylindrical manifold 22. The lower end wall 128 of the manifold 122 provides the floor of the ballast or accumulator cylindrical chamber 126, which includes a centrally positioned internally threaded aperture to receive the externally threaded upper end 130 of connector 132. The externally threaded lower end 134 of connector 132 is received in the internally threaded inlet port 118 of the operating valve assembly 112.

The check valve 120 includes an elongated cylindrical body 136 having an externally threaded reduced diameter lower end portion 137 threadedly received in the internally threaded portion of elongated receiving cavity 122 which extends between the manifold connecting conduit 34 and the cylindrical chamber 126.

The cylindrical check valve body 136 has a central bore 138 extending longitudinally from its upper end to its lower end. It also includes a plurality of four side wall apertures 140 spaced apart radially and equidistantly around the cylindrical side wall of the valve body 136 and extending therethrough opening to the central bore 138. Each of the apertures 140 is in axial alignment with a corresponding aperture opening to the opposite side of the central bore. When the check valve body 136 is fully seated in the receiving cavity 122 the radially spaced apart side wall apertures 140 open to an annular space around the valve body 136 which is in registration with the outlet port 32 of the manifold receiving chamber 24 and the inlet port 36 of the manifold discharge chamber 30. Thus, pressurized air from the computer controlled supply entering the manifold receiving chamber 24 flows through its outlet port 32, through one of the side wall apertures 140 of the control valve 120 into its central bore 138. It also flows out from the central bore 138 through the opposite axially aligned aperture 140 and through the inlet port 36 of the manifold discharge chamber 30 where it is discharged into the needle control supply line 38 for opening of the nozzle orifice 10 of the spray gun 4.

The central bore 138 includes an internally threaded section 142 which extends upwardly from the location of the radially spaced apart apertures 140, and a slightly enlarged diameter unthreaded section above that extending upwardly to the central bore opening at the upper end of the valve body. A hex nut 144 is formed around the outer wall at the upper end of the valve body.

The central bore 138 includes a first reduced diameter section 146 which extends downwardly from the location of the radially spaced apart apertures 140, having an unthreaded smooth cylindrical wall, the first reduced diameter section 146 terminating at a point downwardly from the apertures 140 which is short of the lower end of the valve body 136, the central bore 138 then continuing downwardly through a second reduced diameter section 148 having a diameter smaller than that of the first reduced diameter section 146, the second reduced diameter section 148 extending downwardly to the central bore opening at the lower end of the valve body 136. An annular ledge 150 extends around the central bore 138 at the juncture between the first and second reduced diameter sections 146 and 148.

Control and adjustment of the check valve 120 is accomplished by the check valve stem 152 and a small freely floating vaned check valve stop member 154 positioned in the first reduced diameter section 146 of the valve body's central bore 138 between the lower end 178 of the valve stem 152 and the annular ledge 150. The stop member 154 comprises a very small diameter longitudinally extending cylindrical body or spine 156 and four vanes 158 radially spaced apart equidistantly extending outwardly from the spine to reach the smooth cylindrical wall of the first reduced section 146 of the central bore 13 of the valve body 136.

The valve stem 152 includes an enlarged diameter externally threaded section 160 for threaded engagement with the internally threaded section 142 of the valve body's central bore 138. An O-Ring 162 is seated in an annular groove of the valve stem immediately above the externally threaded section 160 for sealing engagement with the cylindrical wall of valve body's central bore 138. An annular flange 164 is provided on the valve stem 152 immediately above the O-Ring 162, the annular flange also extending radially outwardly from the valve stem 152 to reach the cylindrical wall of the valve body's central bore 138.

A first reduced diameter section 166 of the valve stem extends upwardly from the annular flange 164 and terminates at the upper end 168 of the valve stem 152. The first reduced diameter valve stem section 166 is externally threaded to receive an internally threaded nut 170 thereon. A hex-sided socket 172 is formed in the upper end wall 174 to receive an Allen wrench for rotating the valve stem to adjust time delay for atomizing air to be shut off to the spray gun 4 after computer controlled pressurized air has been shut off to enable the spray gun needle 8 to re-seat in the nozzle orifice 10 and stop further flow of paint therethrough.

A second reduced diameter section 176 of the valve stem extends downwardly from the threaded section 160 and terminates at the lower end 178 of the valve stem 152. The second reduced diameter section 176 has an unthreaded smooth cylindrical wall surrounding a central bore 180 which extends from its opening at the lower end wall 182 of this second reduced diameter section 176 inwardly thereof to terminate at the level of the threaded section 160 of the valve stem 152. A pair of aligned apertures 184 open to the central bore 180 and to opposite sides of the smooth cylindrical wall of the second reduced diameter section 176 at a location thereon next adjacent to the lower edge of the threaded section 160 of the valve stem 152.

The threaded section 160 of the valve stem 152 is threadedly engaged with the internally threaded section 142 of the control valve body 136. This positions the second reduced diameter section 176 of the valve stem for movement upwardly and downwardly across the region between opposite apertures 140 of the control valve body 136, the manifold receiving chamber outlet port 32 on one side and the manifold discharge chamber inlet port 36 on the opposite side.

When the second reduced diameter section 176 is adjusted to its uppermost position, the lower end 178 of the valve stem is about level with the passageway between the manifold receiving chamber outlet port 32 and the manifold discharge chamber inlet port 36. When it is adjusted to its lowermost position, the pair of aligned apertures 184 of section 176 of the valve stem are at substantially the same level as the aligned apertures 140 of the control valve body 136 and the said ports 32 and 36 of the manifold receiving and discharge chambers. In this lowermost position, the lower end 178 of the valve stem is in bearing engagement against the upper surface of the vaned stop member 154 and the bottom peripheral edges of the vanes 158 are in bearing engagement against the annular ledge 150 around the bore 138 of the control valve body 136. In the uppermost position of the valve stem 152, its lower end 178 is spaced apart upwardly from the annular ledge 150 for the vaned stop member to move upwardly and downwardly within the control valve body bore 138 responsive to pressurized air moving upwardly or downwardly within the valve body bore 138.

The check valve 120 permits pressurized air from the computer controlled source, which opens the needle valve for paint to flow from the spray gun 4, to flow downwardly to the pilot valve assembly 112 which causes that valve to open and simultaneously flow pressurized air from the operating or atomizing air supply source to the air cap apertures of the spray gun 4 to atomize and spray the paint as it emerges from the orifice of the spray gun needle valve. Check valve 120, in conjunction with the cylindrical ballast or accumulator chamber 126, also provides an adjustable delay of return of pressurized air from the pilot valve assembly 112 after pressurized air through supply line 28 from the computer controlled source has been discontinued. Such delay holds the pilot valve assembly 112 in its valve open position for any desired time delay up to thirty seconds, or more if desired, for atomizing air to continue to flow to the spray gun 4 to be sure that any paint which still flows from its nozzle orifice 10 before the needle valve 8 reaches its fully seated and fully closed position will be atomized into a spray and will not come from the spray gun in an unatomized stream which would ruin whatever work was in process.

The pilot valve assembly 112 includes a cylindrical housing 186, a first internally threaded cylindrical recess 188 opening to one side of the housing's cylindrical side wall 190 and a second internally threaded cylindrical recess 192 opening to the opposite side of the cylindrical side wall 190 and axially aligned with the first recess 188. An upper cylindrical cavity 194 extends upwardly from the axially aligned recesses and a lower cylindrical cavity 196 extends downwardly therefrom. A top cover member 198 is provided to cover the upper cylindrical cavity 194 and a lower cover member 200 is provided to cover the lower cylindrical cavity 196.

A longitudinal connecting port 202 extends between and connects the upper and lower cavities, opening to a tapered upper cavity valve seat 204 in the center of the bottom wall 206 of the upper cavity 194 at the upper end of connecting port 202, and opening to a tapered lower cavity valve seat 208 in the center of the top wall 21? of the lower cavity 196 at the lower end of the connecting port 202.

An air inlet aperture 212 is provided through the top wall 210 of the lower cavity 196 which opens to the first internally threaded cylindrical recess 188 near its inner end. One end of threaded fitting 214 is threadedly received in this first internally threaded recess 188 and its other end is connected to supply line 116 to supply operating or atomizing pressurized air to the operating valve assembly 112 through the first threaded coupling recess 188 and inlet aperture 212 to the lower cylindrical cavity 196.

An air outlet aperture 216 is provided through the longitudinal cylindrical side wall of connecting port 202 which opens to the second internally threaded cylindrical recess 192 through its inner end wall. The externally threaded wall of the inlet port 68 of the venturi nozzle 66 is threadedly received in and coupled to internally threaded recess 192. Thus, when the connecting port 202 is open at its lower cavity valve seat 208, pressurized air which is flowed into the lower cylindrical cavity 196 flows into connecting port 202 and out through the air outlet aperture 216 into the venturi nozzle 66 and the elongated venturi member 62 to ultimately supply atomizing air to the spray gun 4.

A two-way valve operating member 218 closes one of the valve seats 204 or 208 when it opens the other. It includes a valve stem 220 of brass or other metal positioned for reciprocal movement in the vertically extending connecting port 202, the valve stem 220 having a smaller diameter than that of connecting port 202, the upper end of the valve stem terminating in a tapered valve head 222 having a dimension and configuration to seat snugly and sealingly in the lower portion of the downwardly extending tapered upper cavity valve seat 204, the lower end of the valve stem terminating in a tapered valve head 224 having a dimension and configuration to seat snugly and sealingly in the upward portion of the upwardly extending tapered lower cavity valve seat 208. The valve stem 220 is slightly longer in its vertical or longitudinal dimension than the connecting port 202, so that when the valve stem 220 is moved in one direction far enough to fully seat one of the valve heads in its corresponding valve seat, the opposite valve head is moved away from its corresponding valve seat.

A first small diameter membrane securing pin 226 extends upwardly from the upper end valve stem head 222 axially aligned with valve stem 220 from which it extends, through the central aperture of upper cavity membrane member 228 which is held to the pin 226 by cap 230 secured to the outer end of the upper securing pin 226.

A second small diameter membrane securing pin 232 extends downwardly from the lower end valve stem head 224 axially aligned with valve stem 220 from which it extends, through the central aperture of lower cavity membrane member 234 which is held to pin 232 by cap 236 secured to the outer end of the lower securing pin 232.

The upper cavity membrane member 228 is circular in its peripheral configuration and made of rubber or other resilient, compressive material having comparable characteristics. It includes a central hub portion 238 surrounding its central aperture, a relatively thin cross-section annular web portion 240 which is imperforate throughout, integrally joined to the central hub portion and extending radially outward therefrom to a relatively thicker cross-section annular rib 242 which forms the outer circumference of the membrane member 228 and to which the annular web portion 240 is also integrally joined.

The outer diameter of upper cavity membrane member 228 corresponds in size to the inner diameter of the cylindrical wall 244 of the upper cylindrical cavity 194, whereby the annual rib 242 provides an air tight seal around the bottom of the upper cylindrical cavity 194. A thin circular metallic support plate 246 having a central aperture 248 is seated in a shallow cylindrical recess 250 provided in the bottom wall 206 of upper cavity 194 co-axial with tapered upper cavity valve seat 204 and connecting port 202. The metallic support plate 248 bears against the underside of the annular web portion 240 of the upper cavity membrane member 228 and supports it in a substantially planar position when air pressure in the upper cavity 194 presses the annular web portion 240 of membrane member 228 and its central hub portion 238 downwardly.

The central hub portion 238 extends downwardly a short distance from the underside of the annular web portion 240 and terminates downwardly at an inwardly tapering frusto-conical lower edge 252 which joins the upper end tapered valve head 222 of the metal valve stem 220 to which the upper cavity membrane member 228 is connected by securing pin 226.

When pressurized air in upper cavity 194 presses membrane member 228 downwardly to bear against the metal support plate 246, the upper end tapered metal valve head 222 seats in the lower portion of the tapered upper cavity valve seat 204 and the frusto-conical lower edge 252 of the rubber (or other comparable compressive material) membrane member 228 seats in the upper portion of such tapered valve seat 204 to provide an air tight seal and closure thereof. The central hub portion 238 has an outer diameter slightly smaller than the diameter of central aperture 248 of the metallic support plate 246 whereby it extends therethrough for reciprocating movement between its valve seat closing position when pressed downward and its valve seat open position when biased upwardly.

The top cover member 198 includes a substantially planar upwardly facing outer surface 254 extending radially from the computer controlled source of pressurized air inlet port 118 to a raised circumferential rib 256. An annular key 258 seated in a corresponding annular key slot around the inner surface of the cylindrical wall of the cylindrical valve housing 186 at its upper end bears against the upper surface of the raised circumferential rib 256 to hold the top cover member 198 in place to cover the upper cylindrical cavity 194.

The top cover member 198 includes a tapering downwardly facing inner surface 260, extending radially from the central bore of the inlet port 118 diverging as it extends outwardly therefrom to a circumferential rib 262 which projects downwardly around the outer lower edge of the cylindrical outer wall of the top cover member 198. The circumferential rib 262 of the metal cover member 198 bears tightly against the rubber (or comparable compressive material) annular rib 242 of the upper cavity membrane member 228 to sandwich it between circumferential rib 262 and the outer circumferential edge of the bottom wall 206 of cylindrical upper cavity 194.

The lower cavity membrane member 234 is also circular in its peripheral configuration and is made of rubber or other resilient, compressive material having comparable characteristics. It includes a central hub portion 264 surrounding its central aperture, four radially and equidistantly spaced apart webs 266 of relatively thin cross-section integrally joined at their inner ends to the hub portion 264 and at their outer ends to a relatively thicker cross-section annular rib 268 which forms the outer circumference of the membrane member 234. Four arcuately elongated openings 270 through the membrane member 234 between its central hub portion and its outer annular rib 268 are provided respectively between the four spaced apart webs 266.

The outer diameter of lower cavity membrane member 234 corresponds in size to the inner diameter of the cylindrical wall 272 of the lower cylindrical cavity 196.

The central hub portion 264 of lower cavity membrane member 234 extends upwardly a short distance from the upper surface of the webs 266 and terminates upwardly at an inwardly tapering frusto-conical upper edge 274 which joins the lower end tapered valve head 224 of the metal valve stem 220 to which the lower cavity membrane member is connected by securing pin 232.

The valve stem 220 and the upper and lower cavity membrane members secured thereto are biased upwardly by compression spring 276, whereby lower cavity valve seat 208 is normally closed and upper cavity valve seat 204 is normally open. When the compression spring 276 biases the valve stem and membrane members upwardly to normally close the lower cavity valve seat 208, the lower end tapered metal valve head 224 of valve stem 220 seats in the upper innermost portion of the tapered lower cavity valve seat 208 and the frusto-conical upper edge 274 of the rubber (or other comparable compressive material) membrane member 234 seats in the lower or outermost portion of such tapered valve seat 208 to provide an air tight seal and closure thereof.

The lower cover member 200 includes a substantially planar downwardly facing outer surface 278 extending radially from a centrally positioned downwardly projecting cylindrical cup portion 280 to a raised circumferential rib 282. An annular key 284 seated in a corresponding annular key slot around the inner surface of the cylindrical wall of the cylindrical valve housing 186 at its lower end bears against the lower surface of the raised circumferential rib 282 to hold the lower cover member 200 in place to cover the lower cylindrical cavity 196.

The lower cover member 200 includes a tapering upwardly facing inner surface 286, extending radially from the cylindrical recess 288 in the cylindrical cup portion 280, diverging as it extends upwardly therefrom to a circumferential rib 290 which projects upwardly around the outer upper edge of the cylindrical outer wall of the lower cover member 200. The circumferential rib 290 of the metal cover member 200 bears tightly against the rubber (or comparable compressive material) annular rib 268 of the lower cavity membrane member 234 to sandwich it between circumferential rib 290 and the outer circumferential edge of the top wall 210 of the cylindrical lower cavity 196.

When pressurized air from the computer controlled source flows through supply line 28 into the control assembly 2 and out through air line 38 to open the needle valve of the spray gun 4 for paint to flow, pressurized air from such source also flows through the downwardly extending bore of check valve body 136 into the cylindrical ballast chamber 126 and through the inlet port 118 of the pilot valve assembly 112. Such pressurized air biases the imperforate membrane member 228 in the upper cavity 194 downwardly to close the upper cavity valve seat 204, which is normally biased upwardly by the compression spring 276 to its valve seat open position. At the same time, lower cavity valve seat 208 is opened. This valve seat is normally closed by compression spring 276 biasing the valve head 224 at the lower end of valve stem 220 and the frusto-conical upper edge 274 of the hub portion of lower cavity membrane member 234 upwardly to seat in and close the lower cavity valve seat 208. As long as this valve seat is closed, pressurized air from the atomizing air supply source cannot flow from supply line 116 and the lower cavity 196 into the longitudinal connecting port 202 and out through the air outlet aperture 216 to the venturi member and on to the spray gun 4 to provide atomizing air thereto.

As soon as pressurized air from the computer controlled supply which opens the needle valve of the spray gun to start flow of paint causes the upper valve seat 204 of pilot valve 112 to close and causes lower valve seat 208 to open, pressurized air from the atomizing supply source then flows immediately through the open lower valve seat 208, into the longitudinal connecting port 202, through air outlet aperture 216 thereof into outlet recess 192, to the venturi member which then draws in ambient air to provide atomizing air to the spray gun 4 to atomize the paint as it flows from the needle valve of the spray gun 4.

When the computer signals the computer controlled source of pressurized air to discontinue further painting operation of the spray gun 4 by shutting such source of pressurized air off, the needle 8 of the spray gun 4 is biased back to its normally closed position seated in the orifice 10 of the spray gun nozzle 12. However, there can be some delay between the time the computer controlled source of pressurized air is shut off and the time when the needle 8 can be fully seated in the nozzle orifice 10 to completely stop the flow of paint. It is an important improvement to continue to provide atomizing air to the spray gun 4 during this time delay interval so that any paint from the nozzle during such interval is atomized and does not flow out in a non-atomized stream.

In accordance with this invention, when pressurized air from the computer controlled source is shut off to allow the needle valve of the spray gun to close, the stem 152 in the bore 138 of check valve 120 retards and controls the outward flow of pressurized air which is in the upper cavity 194 of the pilot valve assembly 112, which has held that valve assembly open for flow of pressurized air from the atomizing air source to the spray gun 4. When the valve stem 152 is rotated to lower its lower end to its lowermost position, at which time the vaned stop member 154 is sandwiched between the lower end of the valve stem 152 and the annular ledge 150 around the central bore 138 of the control valve body 136, the slower that pressurized air can escape from the upper cavity 194 of pilot valve 112, the longer it takes for the bias of the compression spring 276 to overcome the force of such pressurized air in upper cavity 194, and the longer time delay before the lower cavity valve seat 208 is fully closed to shut off further flow of atomizing air to the spray gun 4. If valve stem 152 were to be tightened fully and snugly against the stop member 154 in its lowermost position no air could escape from upper cavity 194 of the pilot valve 112. The lower cavity valve seat would thus remain open and atomizing air would continue to flow indefinitely to the spray gun.

When the valve stem 152 is rotated to raise its lower end from such lowermost position, the higher it is raised, the faster pressurized air can escape from the upper cavity 194 of the pilot valve 112, the less time it takes for the bias of the compression spring 276 to overcome the force of such pressurized air in upper cavity 194, and the less time delay before the lower cavity valve seat 208 is fully closed to shut off further flow of atomizing air to the spray gun 4.

The cylindrical ballast chamber 126 has an enlarged diameter and an enlarged cavity to receive and hold a relatively large volume of pressurized air between, and in communication with, the check valve 120 and the pilot valve assembly 112. Such relatively large volume of pressurized air between the chambers and cavities of the two valves serves as a stabilizing force or buffer to achieve more uniform and predictable operation of the time delay feature of the two valves. Without the ballast chamber or accumulating chamber 126, the time delay after each operation may not always be the same for each setting of the control valve stem 152. The ballast chamber 126 makes it possible for the time delay period to be more nearly the same after each operation for each setting of the control valve.

The valve stem 152 can be adjusted to any desired level for time delay in shut off of atomizing air after shut off of needle opening air from up to thirty seconds or more to any lesser time. When adjusted to a chosen period of time delay, the lock nut 170 can be tightened to hold the valve stem 152 in that chosen position.

I claim:

1. A pressurized air supply and control assembly for use with an automatic spray gun, comprising pressurized air control means to provide pressurized air to a said spray gun to initiate flow of an atomizable liquid therefrom, first connecting means to connect said pressurized air control means to a controlled pressurized air source, second connecting means to connect said pressurized air control means to liquid flow initiating means of a said spray gun, atomizing pressurized air supply means operable between an air flow open and air flow closed position to provide pressurized air when in said air flow open position to a said spray gun to atomize a said atomizable liquid when its flow is initiated from a said spray gun and to discontinue flow of pressurized atomizing air to a said spray gun when in said flow closed position, third connecting means to connect said atomizing pressurized air supply means to an atomizing pressurized air source, fourth connecting means to connect said atomizing pressurized air supply means to atomizing means of a said spray gun, and time delay means connected between said pressurized air control means and said atomizing pressurized air supply means to delay operation of said atomizing pressurized air supply means from its air flow open position to its air flow closed position for a preselected time period after flow of pressurized air from said controlled pressurized air source to said pressurized air control means has been discontinued.

2. A pressurized air supply and control assembly for use with an automatic spray gun as set forth in claim 1, wherein said pressurized air control means to provide pressurized air to a said spray gun to initiate flow of an atomizable liquid therefrom comprises a manifold having a receiving chamber, an inlet port opening to said receiving chamber, said first connecting means including a manifold air inlet fitting connected to said inlet port of said manifold receiving chamber, said manifold having a discharge chamber, an outlet port opening to said discharge chamber, said second connecting means including an air outlet fitting connected to said outlet port of said manifold discharge chamber, a connecting air passageway connecting said receiving chamber and said discharge chamber of said manifold, said time delay means including a coupling air passageway positioned to receive pressurized air from said controlled pressurized air source extending from said manifold of said pressurized air control means to said atomizing pressurized air supply means to couple operation thereof from said air flow closed position to said air flow open position with the initial flow of pressurized air from said controlled pressurized air source to said pressurized air control means for simultaneous flow of controlled pressurized air and atomizing pressurized air to respective ones of said liquid flow initiating means of a said spray gun and to said atomizing means of a said spray gun thereby initiating atomization of a said atomizable liquid at the same time as flow thereof from a said spray gun is initiated.

3. A pressurized air supply and control assembly for use with an automatic spray gun as set forth in claim 2, wherein said atomizing pressurized air supply means to provide pressurized air when in its said air flow open position to a said spray gun to atomize a said atomizable liquid when its flow is initiated from a said spray gun comprises a pilot valve assembly, a first air chamber therein to receive pressurized air from said atomizing pressurized air source, an air inlet port opening to said first air chamber, said third connecting means including a pilot valve inlet fitting connected to said air inlet port of said first air chamber, an air outlet port, said fourth connecting means including a pilot valve outlet fitting connected to said air outlet port, a second air chamber in said pilot valve assembly to receive pressurized air from said controlled pressurized air source, and pilot valve operation means connected between and in communication with said air inlet port opening to said first air chamber, said air outlet port, and said second air chamber operable between an air flow open and air flow closed position to permit atomizing pressurized air to flow from said air inlet port to said air outlet port when in said air flow open position and to stop said flow of atomizing pressurized air when in said air flow closed position, said operation of said pilot valve operation means between said air flow open and air flow closed positions being responsive to pressurized air received in said second chamber from said controlled pressurized air source in communication with said pilot valve operation means.

4. A pressurized air supply and control assembly for use with an automatic spray gun as set forth in claim 3, wherein said second air chamber includes a second chamber inlet port opening thereto connected to said coupling air passageway of said time delay means, a valve aperture opening thereto, said pilot valve operating means includes a valve passageway to permit air to flow through said pilot valve operation means, a valve closure member movable between a valve open and valve closed position to permit air to flow through said valve passageway when in said valve open position and to prevent air from flowing through said valve passageway when in said valve closed position, and a valve operator to move said valve closure member between said valve open and said valve closed positions, said valve operator including an air pressure responsive member positioned in said second air chamber and a valve connecting member extending through said valve aperture of said second air chamber connected at one end to said air pressure responsive member in said second air chamber and at its opposite end to said valve closure member, whereby said air pressure responsive member moves said connecting member of said valve operator in the direction to move said valve closure member to its said valve open position when pressurized air from said controlled pressurized air source is received in said second air chamber through said coupling air passageway of said time delay means.

5. A pressurized air supply and control assembly for use with an automatic spray gun as set forth in claim 4, wherein said air pressure responsive member positioned in said second air chamber comprises a resilient membrane secured around its peripheral edges within said second air chamber, said membrane having an imperforate surface throughout, a first surface facing in the direction of said second chamber inlet port connected to said coupling air passageway of said time delay means and pressurized air from said controlled pressurized air source emitted therefrom, said membrane having an oppositely facing second surface facing in the direction which said valve connecting member of said valve operator extends for its connection to said valve closure member, said valve connecting member being connected at its other end to said membrane.

6. A pressurized air supply and control assembly for use with an automatic spray gun as set forth in claim 4, wherein said pilot valve assembly includes biasing means positioned therein to normally bias said valve closure member to said valve closed position when no pressurized air from said controlled pressurized air source is present in said second air chamber.

7. A pressurized air supply and control assembly for use with an automatic spray gun as set forth in claim 6, wherein said biasing means includes a compression spring.

8. A pressurized air supply and control assembly for use with an automatic spray gun as set forth in claim 4, wherein said time delay means includes a time delay valve assembly positioned in said coupling air passageway, said time delay valve assembly includes a valve passageway to permit air to flow therethrough, an upstream valve port positioned to receive pressurized air therethrough and into said valve passageway from said controlled pressurized air source as it reaches said coupling air passageway, a downstream valve port to discharge said pressurized air from said valve passageway into said coupling air passageway on the downstream side of said downstream valve port, and time delay valve operating means positioned between said upstream valve port and said downstream valve port operable to maximize air flow in the direction from said upstream valve port to said downstream valve port and to adjustably reduce air flow in the reverse direction from said downstream valve port to said upstream valve port.

9. A pressurized air supply and control assembly for use with an automatic spray gun as set forth in claim 8, wherein said time delay valve assembly includes an upstream valve outlet port positioned to flow a portion of the pressurized air from said controlled pressurized air source received in said valve passageway through said first mentioned upstream valve port out through said upstream valve outlet port into said discharge chamber of said manifold and on to said liquid flow initiating means of a said spray gun.

10. A pressurized air supply and control assembly for use with an automatic spray gun as set forth in claim 9, wherein said time delay valve operating means includes a valve stem member positioned in said valve passageway having a downstream portion thereof extending between said upstream valve port and said downstream valve port, said valve stem member having an elongated cylindrical side wall terminating at its downstream end in a cavity outlet aperture opening to a cylindrical cavity in said valve stem member extending inwardly thereof in the upstream direction, a pair of diametrically opposed valve stem ports opening to opposite sides of said cylindrical side wall of said valve stem member and to said cylindrical cavity thereof, said valve stem ports being positioned within said valve passageway to receive pressurized air from said controlled pressurized air source entering said valve passageway through said first mentioned upstream valve port and to discharge such pressurized air through said upstream valve outlet port, said valve passageway including an abutment ledge therein spaced apart downstream from said downstream end of said valve stem member, an air flow control member received in said valve passageway between said downstream end of said valve stem member and said abutment ledge for reciprocal movement therebetween, said air flow control member having air flow facilitating means to facilitate air flow in the direction from said cavity outlet aperture in the downstream end of said valve stem member toward said downstream valve port of said valve passageway and air flow impeding means to impede air flow in the opposite direction.

11. A pressurized air supply and control assembly for use with an automatic spray gun as set forth in claim 10, wherein said air flow control member comprises a small central body portion of lightweight material having a cross-section smaller than that of said valve passageway whereby air can flow past said flow control member, a plurality of radially spaced apart vanes extending outwardly from said central body portion which reach the interior cylindrical wall of said valve passageway, said air flow facilitating means including said plurality of radially spaced apart vanes which permit air to flow past said central body portion between said radially spaced apart vanes, said air flow control member including an outwardly projecting plug at its upstream end in facing relationship with said valve stem cavity outlet aperture and having a diameter corresponding to that of said cavity outlet aperture to seat therein when moved into engagement therewith to thereby impede flow of air in the direction from said downstream valve port toward said upstream valve port, said air flow impeding means including said outwardly projecting plug which impedes flow of air in said direction toward said upstream valve port when said plug is received in said valve stem cavity outlet aperture.

12. A pressurized air supply and control assembly for use with an automatic spray gun as set forth in claim 11, wherein said valve stem member is adjustable in said valve passageway to lengthen and shorten the distance between said valve stem cavity outlet aperture and said abutment ledge in which space said air flow control member is positioned for reciprocal movement therebetween, such air flow control member being movable in the direction from said abutment ledge toward said valve stem cavity outlet aperture responsive to the pressure of air flowing outwardly from said second air chamber of said pilot valve assembly in the direction toward said time delay valve assembly and said upstream valve port, a greater amount of such air pressure being needed to move said air flow control member into full air impeding seating relationship with said valve stem cavity outlet aperture when it is spaced apart farther from said abutment ledge than when it is closer, whereby the farther said valve stem member is moved and adjusted into said valve passageway of said time delay valve assembly to shorten said distance the quicker said air flow control member will seat in and more fully impede flow of air in the direction outwardly from said second air chamber of said pilot valve assembly, the longer it will take for pressurized air in said second air chamber to be discharged therefrom and the longer such air pressure responsive member therein of said pilot valve operator will hold said pilot valve closure member in its said valve open position for atomizing pressurized air to flow to said atomizing means of a said spray gun.

13. A pressurized air supply and control assembly for use with an automatic spray gun as set forth in claim 4, including an accumulating air chamber having an enlarged air cavity to receive and hold an accumulated volume of pressurized air and accumulating air chamber connecting port means to connect said accumulating air chamber to said coupling air passageway for receipt of pressurized air from said controlled pressurized air source into said accumulating air chamber when such pressurized air is flowing through said coupling air passageway to said second air chamber of said pilot valve assembly and for discharge of pressurized air therefrom when such pressurized air is flowing in the opposite direction through said coupling air passageway from said second air chamber of said pilot valve assembly.

14. A pressurized air supply and control assembly for use with an automatic spray gun as set forth in claim 1, wherein said atomizing air supply means includes a venturi assembly connected therein to receive pressurized air from said atomizing pressurized air source and to draw ambient air into said venturi assembly for discharge of relatively higher volume and lower pressure atomizing air from said venturi assembly comprising a combination of said ambient air and said pressurized air from said atomizing pressurized air source.

15. A pressurized air supply and control assembly for use with an automatic spray gun as set forth in claim 14, wherein said venturi assembly comprises an elongated cylindrical venturi member having a cylindrical passageway therethrough opening to a downstream outlet port, said passageway flaring outwardly to provide a throat section at a location upstream from said outlet port, a plurality of ambient air apertures through and spaced apart radially around the cylindrical wall of said venturi member opening to said passageway at a location adjacent to and upstream from said throat section, said elongated venturi member including a solid end wall at its upstream end, a venturi nozzle receiving aperture through said upstream end wall, a venturi nozzle received therein having a relatively large diameter cylindrical passageway at its upstream end and tapering to a relatively small diameter cylindrical passageway at its downstream end, said venturi nozzle having an outer cylindrical wall of large diameter upstream tapering to a small diameter neck portion downstream terminating at a forward end having a reduced diameter nozzle outlet opening thereto positioned centrally within said cylindrical passageway of said elongated venturi member and opening to said outwardly flared throat section thereof.

16. A pressurized air supply and control assembly for use with an automatic spray gun as set forth in claim 15, including a cylindrical sleeve member having a cylindrical wall and a cylindrical cavity therein, an upstream portion of said elongated venturi member received in said cylindrical cavity of said sleeve member, an annular air space between the inner surface of said cylindrical wall of said sleeve member and the outer cylindrical wall of said elongated venturi member at the region thereof which extends rearwardly and upstream from said throat section, a sleeve member aperture through said cylindrical wall of said sleeve member opening to said annular air space at the location to which said ambient air apertures of said elongated venturi member also open, for passage of ambient air through said sleeve member aperture and said ambient air apertures of said venturi member into said cylindrical passageway thereof, and an air filter member connected to said sleeve member aperture to filter ambient air passing therethrough.

* * * * *